US007252039B1

(12) United States Patent
Bosshart

(10) Patent No.: US 7,252,039 B1
(45) Date of Patent: Aug. 7, 2007

(54) BALLAST DISCHARGE CAR

(75) Inventor: John H. Bosshart, North Richland Hills, TX (US)

(73) Assignee: BNSF Railway Company, Fort Worth, TX (US)

( * ) Notice: Subject to any disclaimer, the term of this patent is extended or adjusted under 35 U.S.C. 154(b) by 0 days.

(21) Appl. No.: 10/746,002

(22) Filed: Dec. 26, 2003

Related U.S. Application Data

(60) Provisional application No. 60/436,803, filed on Dec. 26, 2002.

(51) Int. Cl.
*B61D 3/00* (2006.01)
*E02F 5/08* (2006.01)

(52) U.S. Cl. ..... 105/256; 37/107

(58) Field of Classification Search ..... 105/238.1, 105/239, 247, 248, 250, 256
See application file for complete search history.

(56) References Cited

U.S. PATENT DOCUMENTS 3,900,392 A * 8/1975 Speno et al. ..... 209/241
4,082,045 A * 4/1978 McNally et al. ..... 105/411
4,361,096 A * 11/1982 Funk ..... 105/248
4,389,150 A * 6/1983 Stenlund ..... 414/505
4,556,112 A * 12/1985 Theurer et al. ..... 171/16
4,923,355 A * 5/1990 Mancini ..... 414/339
5,119,738 A * 6/1992 Snead ..... 105/250
5,402,874 A * 4/1995 Dahlin et al. ..... 198/300
5,499,899 A * 3/1996 Hibbs ..... 414/809
6,571,718 B2 * 6/2003 Lucas ..... 105/282.3
6,637,346 B2 * 10/2003 Gaydos ..... 105/247

* cited by examiner

*Primary Examiner*—S. Joseph Morano
*Assistant Examiner*—Robert J. McCarry, Jr.
(74) *Attorney, Agent, or Firm*—Thompson & Knight LLP; James J. Murphy

(57) ABSTRACT

A ballast discharge car having at least one non-pivoting transverse conveyor disposed beneath a hopper for distributing the ballast between the rails, near the outside of the rails, and well beyond the outside of the rails in a stockpiling application. The speed, direction, and angle of each conveyor is adjustable so that the ballast can be selectively cast a wide range of distances from the outside of the rails.

19 Claims, 3 Drawing Sheets

115b
124
135
121
123
133a
131
129
122
C
A
A
120
124
133
B
115a
111

BALLAST DISCHARGE CAR

CLAIM OF PRIORITY

This application claims the benefit of U.S. Provisional Patent Application Ser. No. 60/436,803, filed 26 Dec. 2002, entitled "BALLAST DISCHARGE CAR." This provisional application is incorporated herein as if fully set forth.

BACKGROUND OF THE INVENTION

1. Field of the Invention

The present invention relates to railroad cars. In particular, the present invention relates to ballast discharge cars for distributing ballast along railways.

2. Description of Related Art

There are many different types of ballast discharge cars in the railroad industry. Some are designed for low speed applications, such as air dump cars, and others are designed for high speed applications. Most are very complicated, involving many different moving parts, multiple conveyors, and even multiple railcars. Many of these ballast discharge cars are, in fact, ballast collection and cleaning cars that undercut the ballast, convey it up into shaker assemblies, and then redistribute it back down onto the railway.

Only a few ballast discharge cars include simple mechanisms for discharging ballast outside of the rails. These cars typically employ a conveyor mounted beneath a hopper that pivots out into a position in which the end of the conveyor is located well beyond the side of the railcar. This type of arrangement is undesirable because the extended conveyor can either damage or be damaged by obstacles near the railway.

One main shortcoming of conventional ballast discharge cars is that they are designed to only distribute ballast either between the rails or only a short distance outside of the rails. These conventional ballast discharge cars are not designed to distribute the ballast very far outside of the rails, and they are not designed to stockpile the ballast far beyond the outside of the rails.

Although there have been many developments in the area of ballast discharge cars, many shortcomings remain.

SUMMARY OF THE INVENTION

There is a need for a simple ballast discharge car that can distribute ballast between the rails, near the outside of the rails, and well beyond the outside of the rails in a stockpiling application.

Therefore it is an object of the present invention to provide a simple ballast discharge car that can distribute ballast between the rails, near the outside of the rails, and well beyond the outside of the rails in a stockpiling application.

This object is achieved by providing a ballast discharge car having at least one non-pivoting transverse conveyor disposed beneath a hopper for distributing the ballast between the rails, near the outside of the rails, and well beyond the outside of the rails in a stockpiling application. The speed, direction, and angle of each conveyor is adjustable so that the ballast can be selectively cast a wide range of distances from the outside of the rails.

The present invention provides significant advantages over the prior art, including: (1) complicated collection and cleaning systems are not required; (2) multiple railcars are not required; (3) a single car can distribute ballast between the rails, near the outside of the rails, and well beyond the outside of the rails; (4) ballast can be stockpiled well beyond the outside of the rails; (5) the conveyor does not have to pivot; (6) the conveyor is never positioned beyond the side of the car; (7) the ballast can be distributed at relatively high speeds; (8) the conveyor assembly can be retrofit onto existing ballast discharge cars; (9) the angle of the conveyor can be adjusted so that the angle of projection of the ballast coming off of the conveyor can be adjusted; (10) the speed of the conveyor can be adjusted so that the speed of projection of the ballast coming off of the conveyor can be adjusted; and (11) the direction of rotation of the conveyor can be reversed so that each conveyor can distribute ballast on either side of the railway.

The above as well as additional objectives, features, and advantages will become apparent in the following description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

Figure 1:
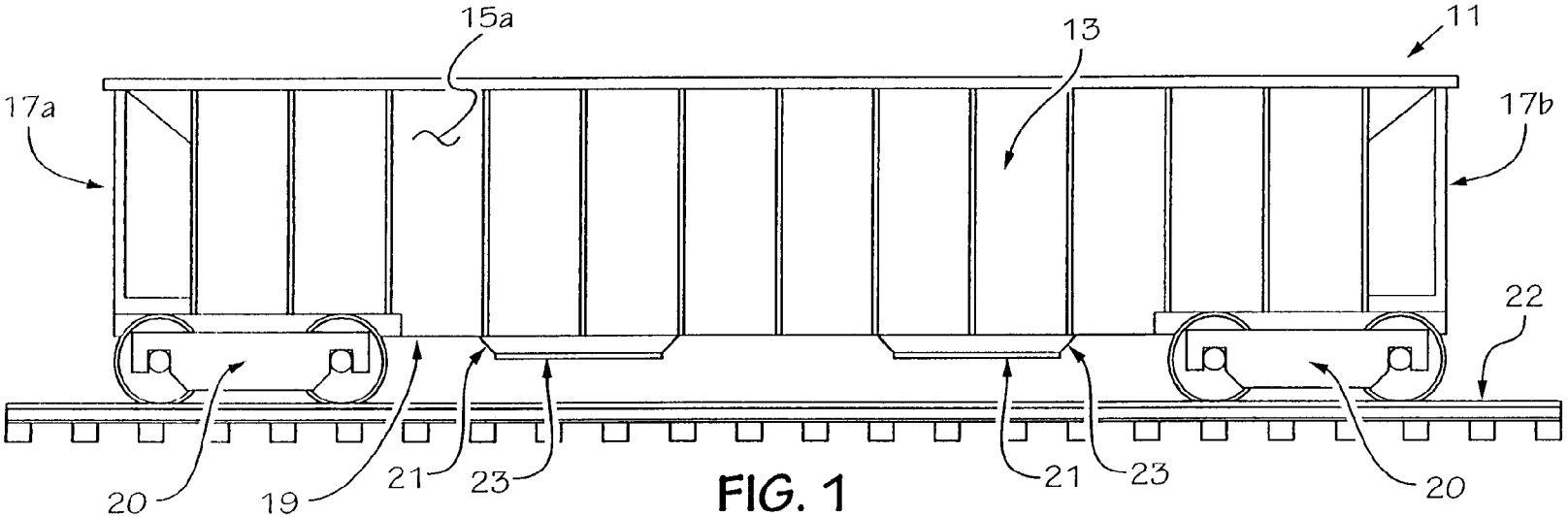
FIG. 1 is a side view of a prior-art ballast discharge car.

Referring to FIG. 1 in the drawings, a prior-art ballast discharge car 1 is illustrated. Ballast discharge car 11 is typical of a 100-ton ballast car, and has a ballast compartment 13 for storing ballast that is formed by a pair of upright side walls 15, a pair of end walls 17*a* and 17*b*, and a generally horizontal deck 19. A pair of wheel assemblies 20 are coupled to deck 19 to allow ballast discharge car 11 to ride on a set of rails 22. At least one hopper 21 is coupled to deck 17 to allow access to the ballast. Each hopper 21 includes a discharge gate 23 that can be opened and closed to allow the ballast to be discharged through hopper 21 onto the railway. Hoppers 21 and/or gates 23 are typically capable of pivoting about a longitudinal axis so that the ballast can be directed somewhat from side to side between rails 22 and just outside of rails 22.

Figure 2:
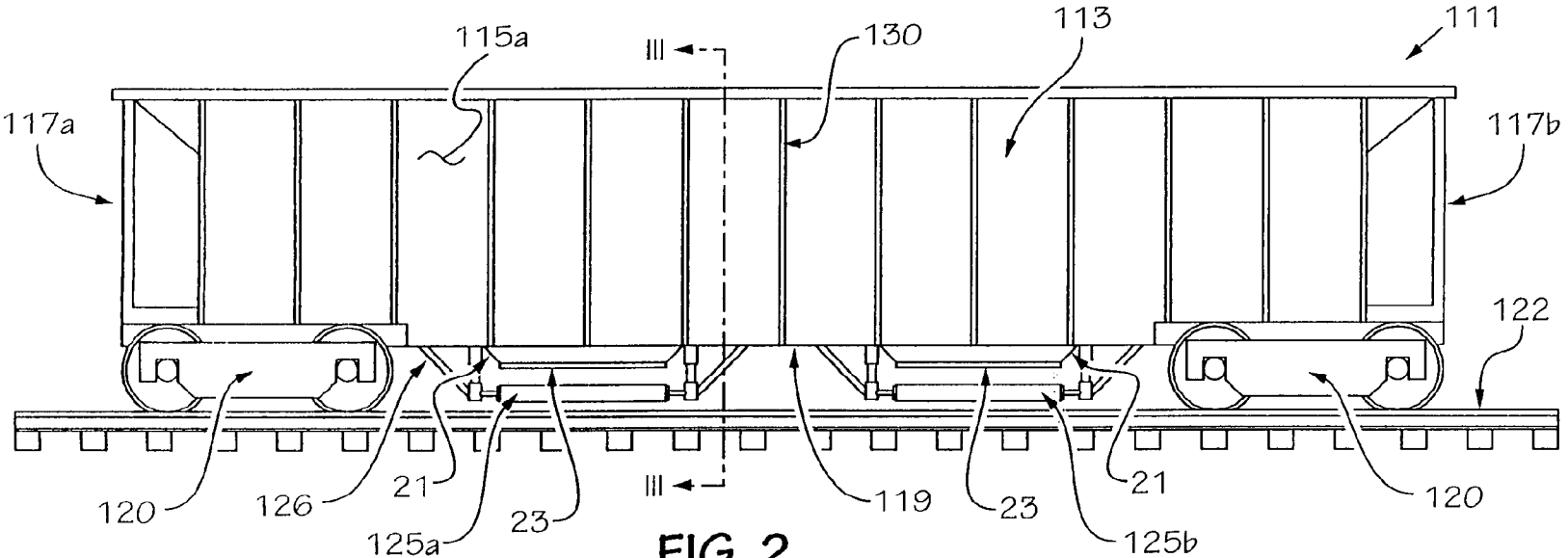
FIG. 2 is a side view of the ballast discharge car according to the present invention.

Referring now to FIG. 2 in the drawings, a ballast discharge car 111 according to the present invention is illustrated. Ballast discharge car 111 has a ballast compartment 113 that is formed by a pair of upright side walls 115*a* and 115*b*, a forward end wall 117*a*, a rear end wall 117*b*, and a generally horizontal deck 119 for storing ballast 124 (see FIG. 3). It is preferred that ballast compartment 113 have a capacity to store and carry up to about 100 tons of ballast. A pair of wheel assemblies 120 are coupled to deck 119 to allow ballast discharge car 111 to ride on a set of rails 122. At least one hopper 121 is coupled to or integrated into deck 117 for directing the flow of ballast 124. In the preferred embodiment, ballast discharge car 111 is configured with two hoppers 121, one located in or integrated into the forward portion of ballast discharge car 111, and one located in or integrated into the rear portion of ballast discharge car 111.

In the preferred embodiment, hoppers 121 are defined by at least one transverse brace member 130 extend across ballast compartment 113 near the longitudinal midpoint of ballast discharge car 111. Brace member 130 is anchored to side walls 115*a* and 115*b*, deck 119, and/or a longitudinal ridge 135 (see FIG. 3) coupled to or integral with deck 119 to provide added strength and prevent side walls 115*a* and 115*b* from bulging due to the load of ballast 124. In the preferred embodiment, brace member 130 is configured as a truss assembly having holes or voids. This allows ballast 124 to pass through brace member 130, thereby maintaining an even distribution throughout ballast compartment 113.

At least one discharge gate 123 is operably associated with each hopper 121. Discharge gates 123 can be selectively opened and closed to allow ballast 124 to be discharged through hopper 121. In the preferred embodiment, discharge gates 123 are selectively opened and closed by sliding either longitudinally or transversely. However, it will be appreciated that discharge gates 123 may also be opened and closed by pivoting about longitudinal axes 127, which would allow ballast 124 to be directed from side to side as it is released from ballast compartment 113.

A conveyor system is operably associated with each hopper 121. In the preferred embodiment, a forward conveyor system 125*a* is operably associated with forward hoppers 121, and a rear conveyor system 125*b* is operably associated with rear hoppers 121. Conveyor systems 125*a* and 125*b* are configured and adjustably coupled to deck 119, so as to be disposed at least partially below hoppers 121 and gates 123. As such, conveyor systems 125 and 125*b* may include support members 126. Forward conveyor system 125*a* and rear conveyor system 125*b* are preferably identical in form and function. However, it should be understood that in certain applications, it may be desirable for forward conveyor system 125*a* to be of a different, size, shape, configuration, or operating capacity, than rear conveyor system 125*b*, depending upon the application in which ballast discharge car 111 is being used. It should be understood that all references herein to rear conveyor system 125*a* apply to any such conveyor system installed on ballast discharge car 111.

Figure 3:
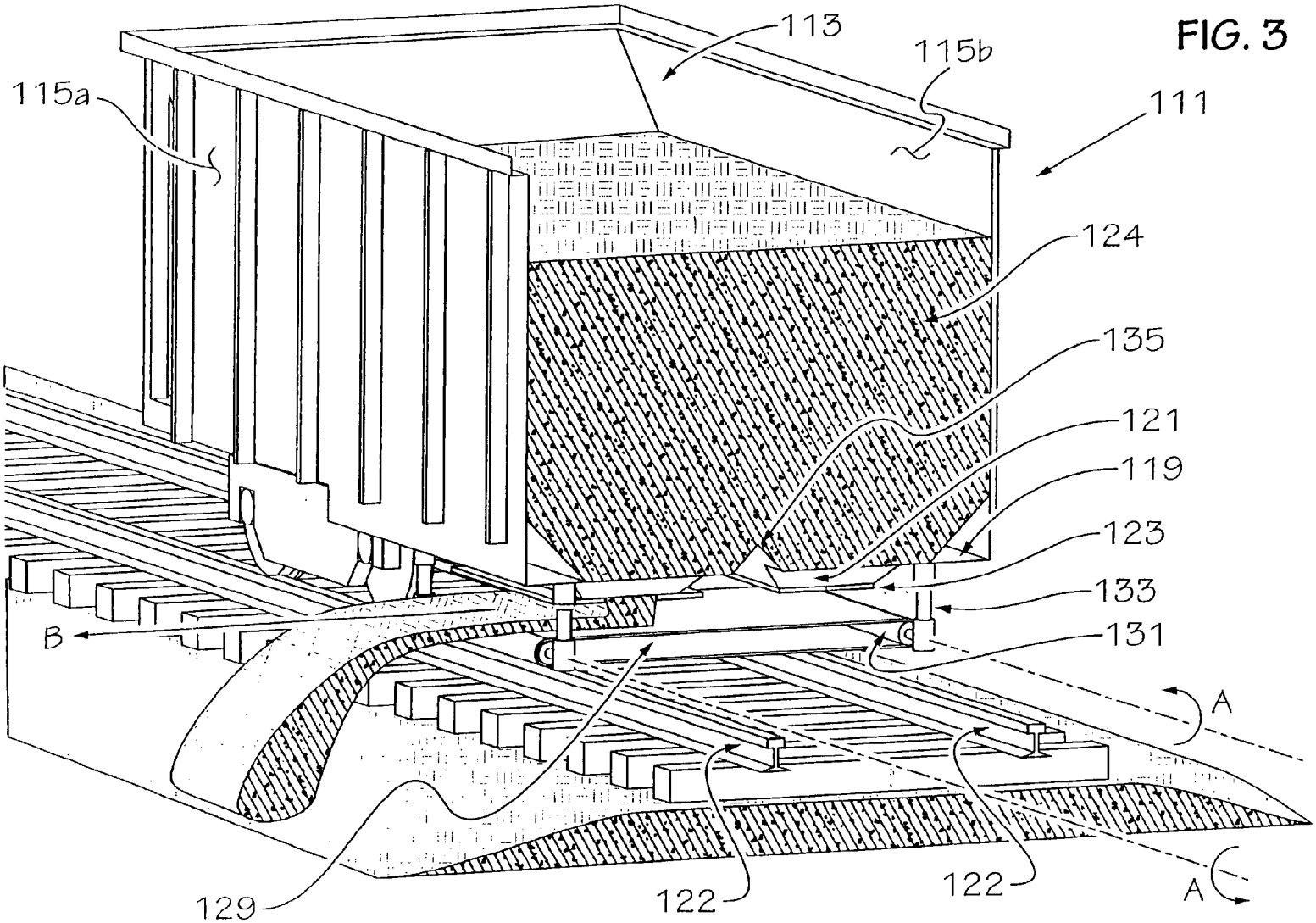
FIG. 3 is a cross-sectional perspective view taken at III-III of FIG. 2 with the conveyor in a generally horizontal position.

Referring now to FIG. 3 in the drawings, ballast discharge car 111 is shown in a partial cross-sectional perspective view taken at III-III of FIG. 2. As is shown, conveyor system 125*a* includes a conveyor belt 129 that extends around at least two longitudinal rollers 131. Rollers 131 are driven by a conventional motor (not shown), preferably a reversible electric motor that is capable of selectively rotating rollers 131 in either a clockwise or counterclockwise direction at various speeds. Conveyor belt 129 and rollers 131 include conventional means for transferring the rotational movement of rollers 131 to conveyor belt 129, such as gears or a friction connection. Conveyor system 125*a* is adjustably coupled to deck 119 via a plurality of adjustable cylinders 133. Cylinders 133 are preferably hydraulic cylinders that may be independently actuated. Cylinders 133 allow conveyor system 125*a* to be selectively raised, lowered, and pivoted about longitudinal and transverse axes. However, in the preferred embodiment, the two cylinders 133 on each side of ballast discharge car 111 are raised and lowered simultaneously and by the same amount. This ensures that conveyer belt 129 pivots only about longitudinal axes. It is preferred that conveyor system 125*a* does not extend outward beyond the side walls 115*a* and 115*b* of ballast discharge car 111. This configuration ensures that conveyor system 125*a* is not damaged by obstacles as ballast discharge car 111 travels along rails 122.

In operation, ballast discharge car 111 is moving down rails 122 at a selected speed. It will be appreciated that the direction of travel of ballast discharge car 111 is immaterial to the operation of the present invention. While ballast discharge car 111 is moving, discharge gate 123 is opened a selected amount. This allows ballast 124 from within ballast compartment 113 to be released at a selected discharge rate through hoppers 121 and discharge gates 123. Thus, it should be understood, that hoppers 121 and gates 123 may opened and closed different amounts and may be pivoted into other positions to selectively discharge ballast 124 from different areas of ballast compartment 113 and at different discharge rates.

In FIG. 3, the rotation of conveyor belt 129 is indicated by an arrow A. As ballast 124 is released through discharge gate 123, ballast 124 falls onto the top of conveyor belt 129. The rotation of conveyor belt 129 causes ballast 124 to be projected outward from side 115*a* of ballast discharge car 111, as is indicated by arrows B. The faster the speed of conveyor belt 129, the farther ballast 124 is projected. In this manner, ballast 124 may be deposited between rails 122, near the outside of rails 122, or may be projected out several meters beyond the outside of rails 122. In fact, conveyor system 125*a* allows ballast discharge car 111 to project ballast 124 out a significant distance beyond the outside of rails 122, so that ballast 124 may be stockpiled for later use. It will be appreciated that by merely reversing the direction of the motor that drives conveyor belt 129, conveyor system 125*a* is capable of projecting ballast 124 out from the other side 115*b* of ballast discharge car 111.

Figure 4:
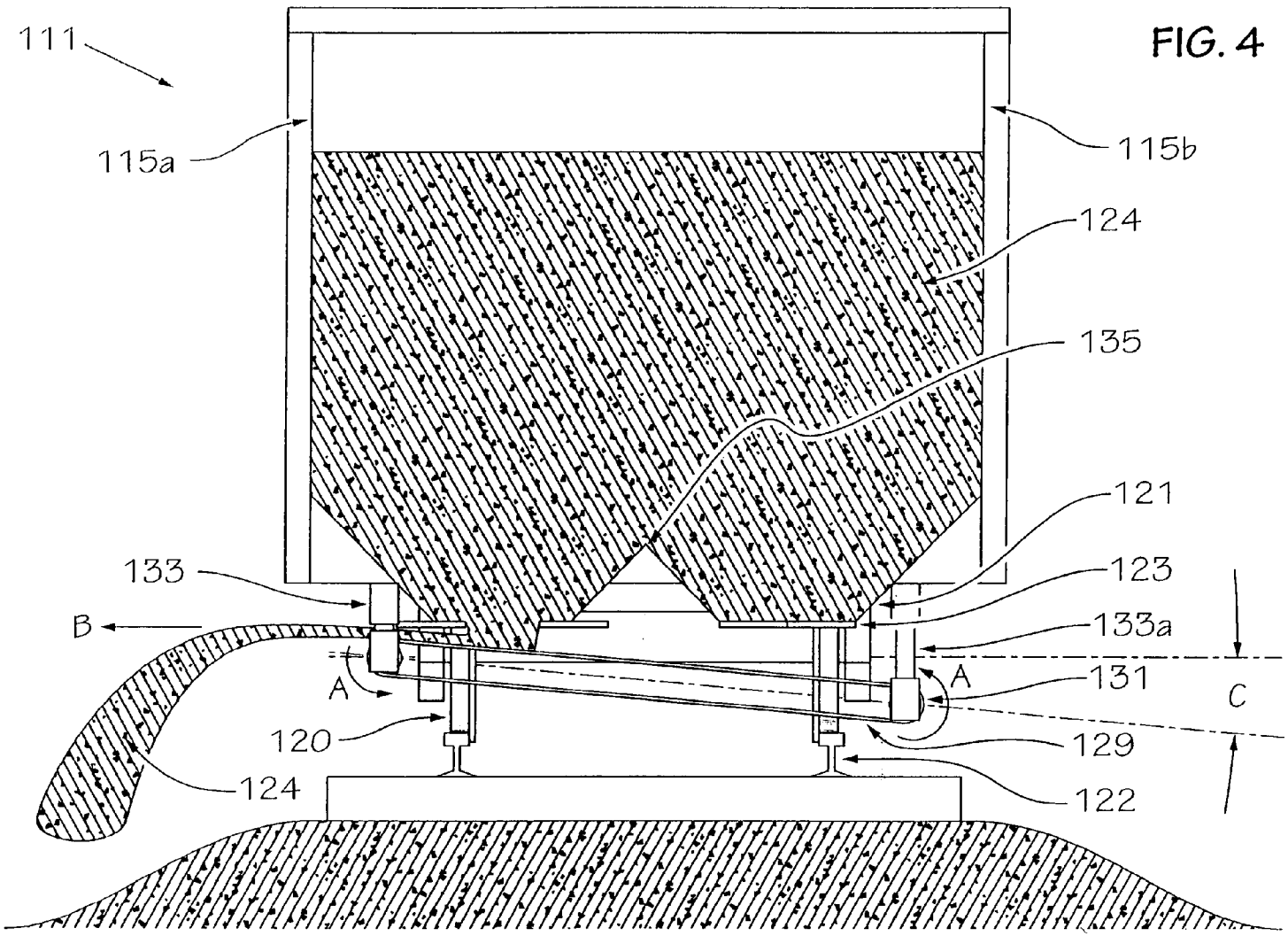
FIG. 4 is a cross-sectional view taken at III-III of FIG. 2 with the conveyor in an inclined position.

Referring now to FIG. 4 in the drawings, ballast discharge car 111 is shown in a cross-sectional view taken at III-III of FIG. 2. In this schematic view, roller 131, which is located on the same side as side wall 115*b*, is lowered downward by extending cylinder 133*a*, such that conveyor belt 129 is inclined at an angle C below the horizontal. If conveyor belt 129 is rotating in the direction of arrow A, then ballast 124 is projected outward and upward at an initial angle C above the horizontal. This inclination of conveyor belt 129 allows ballast to be projected even farther outward past the outside of rails 122 than the configuration of FIG. 3. It will be appreciated that all four cylinders 133 may be selectively and independently adjusted to raise and lower conveyor belt 129, and to obtain specific angles of projection C. By varying the rate of discharge of ballast 124 through hoppers 121 and discharge gates 123, the angle of projection C, the speed and direction of the motor that drives conveyor belt 129, and the travel speed of ballast discharge car 111 along rails 122, an operator can selectively vary the amount and location of the ballast that is discharged from ballast discharge car 111.

Although conveyor system 125*a* may be manually operated, it is preferred that conveyor system 125*a* be controlled by an automated control system (not shown) that allows an operator to selectively control the operational parameters discussed above. Such an automated control system may include computers, microprocessors, and other components for transmitting and receiving electrical and other operational signals. For example, the control system may be entirely hardwired and controlled from a remote control panel (not shown), or may be or include a wireless control system, such as a radio system, a wireless cellular system, or a satellite system. It should be understood that the control system for the present invention may include a global positioning satellite system to aid in geographically locating ballast discharge car 111 at any given time, and for coordinating the opening and closing of discharge gates 123.

In an alternate embodiment of the present invention, conveyor system 125*a* is installed as a retrofit application onto an existing ballast discharge car, such as prior-art ballast discharge car 11. Such a retrofit is possible by merely coupling support members 126 and/or cylinders 133 to the deck of the existing ballast discharge car beneath its discharge gates. This can be done by welding, bolting, or any other suitable attachment means. It will be appreciated that conveyor system 125*a* may be releasably installed onto a ballast discharge car, such that conveyor system 125*a* can be interchangeably uninstalled and reinstalled without difficulty.

The present invention provides significant advantages over the prior art, including: (1) complicated collection and cleaning systems are not required; (2) multiple railcars are not required; (3) a single car can distribute ballast between the rails, near the outside of the rails, and well beyond the outside of the rails; (4) ballast can be stockpiled well beyond the outside of the rails; (5) the conveyor does not have to pivot; (6) the conveyor is never positioned beyond the side of the car; (7) the ballast can be distributed at relatively high speeds; (8) the conveyor assembly can be retrofit onto existing ballast discharge cars; (9) the angle of the conveyor can be adjusted so that the angle of projection of the ballast coming off of the conveyor can be adjusted; (10) the speed of the conveyor can be adjusted so that the speed of projection of the ballast coming off of the conveyor can be adjusted; and (11) the direction of rotation of the conveyor can be reversed so that each conveyor can distribute ballast on either side of the railway.

It is apparent that an invention with significant advantages has been described and illustrated. Although the present invention is shown in a limited number of forms, it is not limited to just those forms, but is amenable to various changes and modifications without departing from the spirit thereof.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

What is claimed is:

1. A railcar for discharging ballast along a railway, comprising:

(a) a ballast compartment defining a volume of space for carrying said ballast;

(b) a deck which is coupled to said ballast compartment;

(c) railcar wheel assemblies secured to said deck for engaging rails on said railway;

(d) said ballast compartment having a central longitudinal axis which is generally aligned with said railway and a vertical axis which is generally perpendicular to said longitudinal axis;

(e) at least one hopper coupled to or integrally formed with said deck for directing downwardly ballast within said ballast compartment;

(f) at least one discharge gate, each being operatively associated with a particular one of said at least one hopper, which may be selectively opened and closed to permit a downward passage of ballast;

(g) at least one conveyor subassembly coupled to said railcar and located generally below said at least one discharge gate, said at least one conveyor assembly having first and second ends both substantially fixed with respects to rotation about the vertical axis of said ballast compartment and including:

(1) a conveyor belt;

(2) a motor;

(3) a roller system for moving said conveyor belt in response to activation of said motor; and (4) at least one actuator member coupled to each of corresponding ones of the first and second ends of said conveyor belt for selectively raising and lowering in concert said first and second ends of said conveyor belt relative to one another which determines an amount of pivot of said conveyor belt relative to said central longitudinal axis;

(h) wherein, during operation, ballast is discharged laterally a distance which is at least in part determined by a speed of operation of said at least one conveyor subassembly and said amount of pivot of said conveyor belt relative to said central longitudinal axis, said amount of pivot of said conveyor belt allowing discharge of said ballast onto the ground in an area adjacent to a selected rail on said railway, said adjacent area separated by said selected rail from an area defined between a pair or rails on said railway on which said railcar wheel assemblies are engaged.

2. A railcar according to claim 1, wherein said ballast compartment is generally rectangular in shape.

3. A railcar according to claim 1, wherein said ballast compartment is adapted to carry approximately one hundred tons.

4. A railcar according to claim 1, wherein said ballast compartment includes at least one transverse brace member which extends across said ballast compartment in order to provide strength and prevent sidewalls of said ballast compartment from bulging due to the load of ballast.

5. A railcar according to claim 4, wherein said at least one transverse brace member is configured as a truss assembly having holes or voids therein, thereby maintaining an even distribution of ballast throughout said ballast compartment.

6. A railcar according to claim 1, wherein said at least one discharge gate may be selectively opened and closed by at least one of the following:

(1) sliding at least a portion of said at least one discharge gate longitudinally;

(2) sliding at least a portion of said at least one discharge gate transversely (3) pivoting at least a portion of said at least one discharge gate relative to said central longitudinal axis.

7. A railcar according to claim 1, wherein said railcar includes a plurality of discharge subassemblies, with each discharge subassembly including:

(1) at least one hopper;

(2) at least one discharge gate; and (3) at least one conveyor subassembly.

8. A railcar according to claim 1, wherein said motor of said at least one conveyor subassembly comprises at least one of the following:

(1) an electric motor;

(2) a reversible motor; and (3) a variable speed motor.

9. A railcar according to claim 1, wherein said conveyor belt of said at least one conveyor subassembly may be rotated clockwise or counterclockwise.

10. A railcar according to claim 1, wherein said conveyor belt of said at least one conveyor subassembly may be operated at various speeds.

11. A railcar according to claim 1, wherein said at least one actuator member comprises a plurality of actuator cylinders.

12. A railcar according to claim 11, wherein said plurality of actuator cylinders comprise hydraulically operated actuator cylinders.

13. A railcar according to claim 11, wherein said plurality of actuator cylinders may be utilized to raise, lower, or pivot said conveyor belt relative to said deck.

14. A railcar according to claim 13, wherein a plurality of actuator cylinders are located on each side of said conveyor belt and are operated in tandem in order to raise, lower, or pivot one side of said conveyor belt.

15. A railcar according to claim 1, wherein said at least one hopper may be operated over a range of hopper operating conditions.

16. A railcar according to claim 1, wherein said at least one discharge gate may be operated over a range of discharge operating conditions.

17. A railcar according to claim 1, wherein said at least one conveyor subassembly is coupled to said deck.

18. A railcar according to claim 1, wherein said at least one conveyor subassembly projects laterally from said central longitudinal axis a distance no greater than approximately a distance that said deck projects from said central longitudinal axis.

19. A railcar according to claim 1, wherein said at least one conveyor subassembly projects laterally from said central longitudinal axis a distance no greater than approximately a distance that said ballast compartment projects from said central longitudinal axis.

* * * * *